US005192939A

United States Patent [19]

Kossow et al.

[11] Patent Number: 5,192,939

[45] Date of Patent: Mar. 9, 1993

[54] CLEANING DEVICE FOR ROTARY CONTROLS E.G. POTENTIOMETERS AND SWITCHES

[76] Inventors: Alan L. Kossow, 505 Thackeray, Maumee, Ohio 43537; Alec W. Palmer, 6238 State Hwy. 109, Delta, Ohio 43515

[21] Appl. No.: 852,010

[22] Filed: Mar. 16, 1992

[51] Int. Cl.[5] ..... H01C 10/10; H01C 13/00; H01H 1/60

[52] U.S. Cl. ..... 338/75; 338/67; 200/242

[58] Field of Search ..... 338/75, 67, 334, 174; 15/312.1, 320, 321, 322; 200/242

[56] References Cited

U.S. PATENT DOCUMENTS

| | | | |
|---|---|---|---|
| 2,085,404 | 6/1937 | Vollenbroek | 338/75 |
| 3,652,970 | 3/1972 | Hubert | 338/174 |
| 3,854,113 | 12/1974 | Fletcher et al. | 338/75 |

*Primary Examiner*—Marvin M. Lateef
*Attorney, Agent, or Firm*—Allen D. Gutchess, Jr.

[57] ABSTRACT

A device for cleaning the contacts of a potentiometer or the like. The potentiometer has an externally threaded cylinder extending outwardly from a panel of an electronic unit and has a concentric rotatable shaft extending therethrough. The shaft has at least one internal contact which rotates when the shaft is rotated and engages a stationary contact in the form of a slide wire or the like of the potentiometer. Contaminants prevent good electrical conduction between the contacts so that the potentiometer must be cleaned, heretofore, requiring partial disassembly of the electronic unit in which it is internally located. The cleaning device has a housing with an open end and a closed end, with the open end having internal threads connecting with the external threads of the cylinder protruding from the electronic unit panel. A small tube communicates with the closed end of the housing and with a pressurized container of contact cleaning fluid. Cleaning fluid under pressure is supplied through the tube, through a chamber formed in the housing, and through an annular space between the shaft and the threaded cylinder to clean the contacts of the potentiometer without the need for disassembly.

5 Claims, 1 Drawing Sheet

CLEANING DEVICE FOR ROTARY CONTROLS E.G. POTENTIOMETERS AND SWITCHES

BACKGROUND OF THE INVENTION

This invention relates to a cleaning device for cleaning electrical movable contacts of rotatable shafts and stationary contacts engagable thereby.

The cleaning device according to the invention is particularly useful with electronic units such as mixers or mixer boards employed in sound systems for music groups. Mixers employed with larger sound systems may have upwardly of forty potentiometers employed therein to achieve the multitudinous sound effects desired by the audience. Particularly where such mixers are exposed to the public, contaminants such as drinks and food can be spilled thereon, causing malfunctioning of the potentiometers employed therein. With or without the public, simply dust and other airborne contaminants can cause similar poor contact in the potentiometers and the malfunctioning thereof.

Heretofore, it has been necessary to partially disassemble the mixer, or other electronic unit having internal potentiometers or similar electronic devices having stationary and movable contacts, to clean the contacts and render them operable again. With an electronic sound mixer, having multiple potentiometers, the cleaning can consume considerable time.

SUMMARY OF THE INVENTION

The cleaning device in accordance with the invention, however, can quickly clean a potentiometer or similar electrical components having an externally threaded cylinder extending through a panel of the unit with a concentric rotatable shaft extending through the cylinder. The rotatable shaft has an internal contact which engages a stationary contact of the electrical component when the shaft is rotated. The stationary contact can be in the form of a slide wire in the case of a potentiometer, for example. The cleaning device comprises a housing of plastic material having an open end and a closed end. The open end has internal threads for connecting with the external threads of the cylinder. The closed end of the housing has a small flexible tube affixed thereto and communicating with a chamber formed by the housing. The tube extends outwardly from the housing where it can be connected to a valve nozzle of a pressurized container of contact cleaner, which is commercially available.

After the housing is screwed onto the threaded cylinder, the pressurized fluid from the container is supplied through the small tube, through the housing chamber, and through an annular space between the rotatable shaft and the threaded cylinder. This fluid contacts and cleans the movable contact of the rotatable shaft and the stationary contact or contacts of the potentiometer. Consequently, the electronic unit and not even the front panel thereof need be disassembled in order to effect cleaning of the contacts and rendering the electronic unit operable again.

It is, therefore, a principal object of the invention to provide a cleaning device for potentiometers or the like having the advantages discussed above.

Many other objects and advantages of the invention will be apparent from the following detailed description of a preferred embodiment thereof, reference being made to the accompanying drawings, in which:

BRIEF DESCRIPTION OF THE INVENTION

FIG. 1 is a somewhat schematic view, with parts in section, of a potentiometer, a cleaning device in accordance with the invention, and a source of cleaning fluid in assembled relationship; and FIG. 2 is an enlarged view in longitudinal cross section of the cleaning device of FIG. 1.

DESCRIPTION OF THE PREFERRED EMBODIMENT

Figure 1:
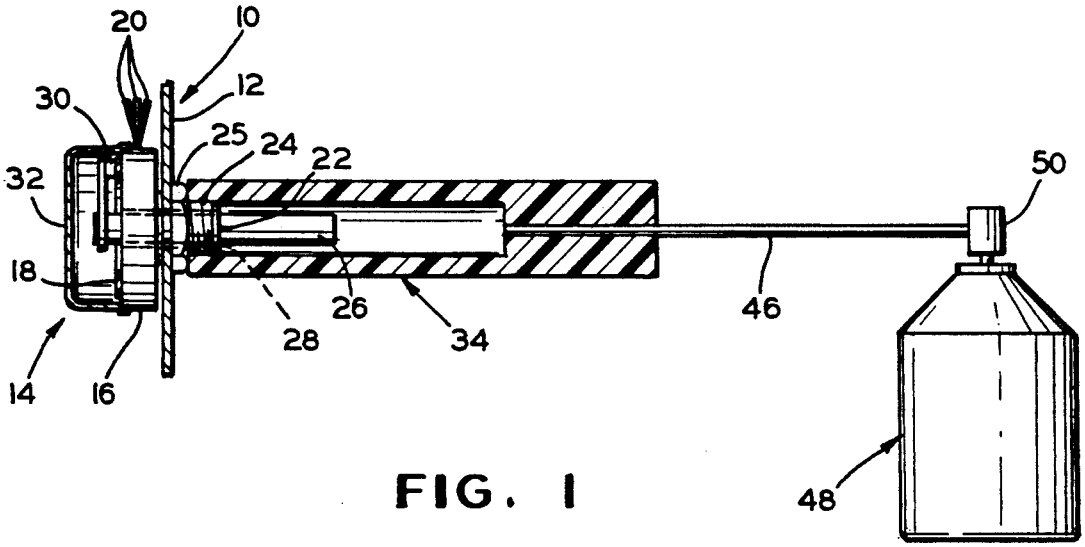
Figure 2:
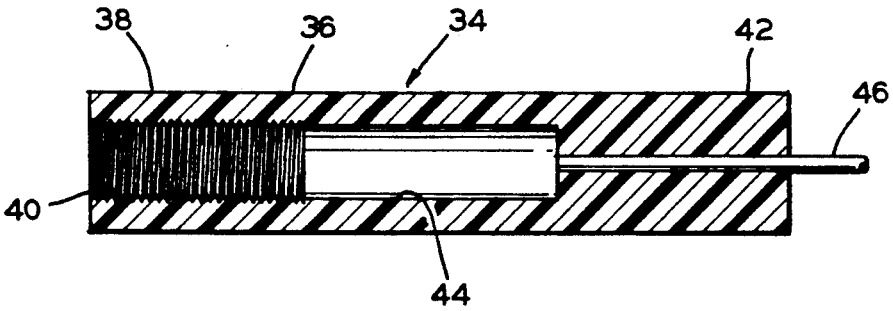

Referring to FIG. 1, an electronic unit which can be a mixer board or the like having as many as forty potentiometers is indicated at 10. It includes a housing (not shown) having a front panel 12. An electronic device or potentiometer 14 is essentially mounted within the mixer. The potentiometer 14 typically has an insulating base 16, a resistive element or slide wire 18 positioned in an arc thereon and constituting at least one stationary contact. In most instances, the resistive element 18 has a high resistance and is connected at one end to one of several external leads indicated at 20.

The potentiometer or other electrical device with which the invention is used also includes a cylinder 22 suitably affixed in the base 16 and extending through the mixer panel 12 with external threads 24. A nut 25 holds the potentiometer in place. A rotatable shaft 26 is concentrically located with respect to a central passage 28 of the cylinder 22 and extends well beyond the panel 12 and also beyond the base 18 to a knob which has been removed. The rotatable shaft 26 carries a rotatable contact 30 which moves therewith and engages the stationary contact or resistive element 18 when the shaft 26 is rotated. The shaft 26 also is electrically connected to one of the external leads 20. As the shaft 26 rotates, the movable contact 30 engages different portions of the element 18 and changes the resistance between the appropriately connected external leads 20.

The potentiometer 14 also has a suitable cover 32 over the base 16. While the cover 32 provides some protection from dust etc. within the unit 10, airborne contaminants and other contaminants such as sticky liquids and food can enter the annular space between the cylinder 24 and the shaft 26. This is especially true with sound mixers where crowds are mingling nearby. Coatings of contaminants interfere with the electrical engagement between the movable contact 30 and the stationary contact or element 18 and render the potentiometer inoperable. In order to clean same, considerable disassembly is required. With an electronic mixer, by way of example, which may have as many as forty potentiometers, the cleaning can be considerably time consuming and expensive.

In accordance with the invention, a cleaning device indicated at 34 is employed. The cleaning device 34 includes a housing 36 which can be of cylindrical configuration and preferably is made of plastic. By being of plastic, the device is lighter in weight, less expensive, and will not damage the external threads 24 of the cylinder 22, if cross threaded. The housing 36 has an open end 38 at one end which has internal threads 40 designed to suitably fit in fluid-tight relationship with the external threads 24 of the cylinder 22. The housing 36 also has a closed end 42 and a chamber 44 formed within the housing 36. A small, flexible tube 46 can be suitably affixed in the closed end 42 of the housing by cement or the like and extends a suitable distance, e.g. four to five inches, therefrom.

When contact cleaning fluid under pressure is supplied through the tube 46. it enters the chamber 44 and flows through the annular space between the rotatable shaft 26 and the cylinder 22. From here it enters the area around the movable contact 30 and the stationary contact or element 18. The cleaning device 34 is then unscrewed and separated from the cylinder and the shaft 26 is turned from end to end several times to spread the cleaning fluid and clean the contacting areas without disassembly of the unit 10 or the potentiometer 14.

In a preferred form, the contact cleaning fluid under pressure is supplied from a commercially-available container 48 (FIG. 1). This type of container has a valve-nozzle head 50 with a small nozzle and a cylindrical recess therearound (not shown) to receive an end of the tube 46. The tube 46 can be adaptable for other types of commercially-available, pressurized containers of contact cleaning fluid, if necessary.

The cleaning device 34 is relatively inexpensive and can be made in several sizes to accommodate different sizes of potentiometers or other electronic devices with different sizes of the cylinders 24 protruding beyond the electronic unit panel 12 of the unit 10.

If necessary, the housing 36 of the cleaning device 34 can also have the open end 38 adaptable to cooperate with other types of cylinders 22 having connections other than threads.

Various modifications of the above-described embodiment of the invention will be apparent to those skilled in the art, and it is to be understood that such modifications can be made without departing from the scope of the invention, if they are within the spirit and the tenor of the accompanying claims.

We claim:

1. In combination, an electronic unit having a panel, at least one potentiometer having an externally-threaded cylinder extending outwardly through said panel and having a concentric rotatable shaft extending therethrough, a cleaning device for contacts of said potentiometer comprising a housing of plastic material having an opening at one end and closed at the other end, said one end having internal threads for connecting with the external threads of said cylinder, a small tube connected with the closed end of said housing and communicating with a chamber formed within said housing, and a pressurized container of contact cleaning fluid communicating with said small tube to supply cleaning fluid to said chamber and to an annular space between said shaft and said threaded cylinder to clean contact areas of said potentiometer.

2. In combination, an electrical component having an externally-threaded cylinder, a rotatable shaft extending therethrough and having a contact movable therewith, said component having at least one stationary contact engagable with said movable contact when the shaft is rotated, a cleaning device for said contacts comprising a housing having an open end and a closed end, said open end having internal threads for connecting with the external threads of said cylinder, and a tube connected with the closed end of said housing and communicating with a chamber formed within said housing, whereby contact cleaning fluid under pressure can be supplied through said tube and said chamber and through an annular space between said shaft and said threaded cylinder to clean said contacts of said electrical component.

3. The combination according to claim 2 wherein said housing is made of plastic material.

4. A cleaning device for a potentiometer located in an electronic unit having a panel, with the potentiometer having an externally-threaded cylinder extending outwardly through the panel and having a concentric rotatably shaft extending therethrough, with the potentiometer having contacts which are engagable when the shaft is rotated, said cleaning device comprising a housing having an open end and closed end, said open end having internal threads for connecting with the external threads of said cylinder, and a small tube communicating with the closed end of said housing and with a chamber formed within said housing, said tube receiving contact cleaning fluid to supply same to said chamber and to an annular space between the shaft and the threaded cylinder to clean the contacts of said potentiometer.

5. A cleaning device according to claim 4 wherein said housing is made of plastic material.

* * * * *